E7831 OR 4,548,352

United States Patent [19]

Capo et al.

[11] Patent Number: 4,548,352

[45] Date of Patent: Oct. 22, 1985

[54] POP-OUT CARTON

[75] Inventors: James L. Capo, Middletown, Ohio; William D. Cunningham, Rocky Mount, N.C.

[73] Assignees: International Paper Company, New York, N.Y.; Hardee's Food Systems, Inc., Rocky Mount, N.C.

[21] Appl. No.: 572,444

[22] Filed: Jan. 20, 1984

[51] Int. Cl.[4] ..... B65D 5/72

[52] U.S. Cl. ..... 229/17 G; 229/16 D; 206/45.29

[58] Field of Search ..... 229/17 G, 16 D; 206/45.13, 45.28, 45.29, 44 R

[56] References Cited

U.S. PATENT DOCUMENTS

| | | | |
|---|---|---|---|
| 1,682,594 | 8/1928 | Benjamin . | |
| 2,205,262 | 6/1940 | Hayes | 46/35 |
| 2,544,783 | 3/1951 | Freedman | 40/126 |
| 2,550,417 | 4/1951 | Klein | 229/8 |
| 2,723,488 | 11/1955 | Ringler | 46/11 |
| 3,365,114 | 1/1968 | Macchi . | |
| 3,403,839 | 10/1968 | Farquhar . | |
| 3,494,536 | 2/1970 | Henry . | |
| 3,581,974 | 6/1971 | Freeman . | |
| 3,640,380 | 2/1972 | Huffman . | |
| 3,684,157 | 8/1972 | Mendez . | |
| 3,739,975 | 6/1973 | Davidow | 229/8 |
| 3,768,720 | 10/1973 | Bundy . | |
| 3,866,814 | 2/1975 | Bissler | 229/8 |
| 4,084,015 | 4/1978 | Patterson | 428/9 |
| 4,201,331 | 5/1980 | Austin . | |
| 4,230,261 | 10/1980 | Austin . | |
| 4,301,614 | 11/1981 | Newton . | |
| 4,307,834 | 12/1981 | Roccaforte . | |
| 4,326,356 | 4/1982 | Mason . | |
| 4,341,341 | 7/1982 | Roccaforte . | |

*Primary Examiner*—Joseph Man-Fu Moy
*Attorney, Agent, or Firm*—Thomas L. Secrest

[57] ABSTRACT

A folding carton is provided with a three-dimensional scene collapsed upon the outer face of one sidewall of the carton. The scene may be folded out, with all elements popping into position simultaneously, to provide a game or other diversion after the primary use of the carton is completed. An auxiliary sidewall is provided with punch out figures or tokens for use in conjunction with the three-dimensional scene.

6 Claims, 5 Drawing Figures

T229/6 X 229/125.42 X 229/103

POP-OUT CARTON

BACKGROUND OF THE INVENTION

This invention relates to folding cartons formed from paperboard or other foldable sheet material. More particularly, the invention relates to a carton having a collapsed three-dimensional scene integral to its surface that may be extended as desired.

Folding cartons of the type having a generally gable top have been used in the carry out food industry. For example, U.S. Pat. Nos. 4,230,261 and 4,307,834 describe such gable top folding cartons. Other types of carry-out cartons, convertible to other uses after their primary uses as food carriers, are disclosed and claimed in our pending U.S. patent applications, Ser. No. 548,251, filed Nov. 2, 1983 (Capo), and Ser. No. 475,374, filed Mar. 13, 1983 (Cunningham). Planar elements collapsed on the surface of a folding carton and extendable therefrom are known in the art. For example, U.S. Pat. No. 3,640,380 shows extendable rings for holding beverage cups.

SUMMARY OF THE INVENTION

This invention relates to a folding carton particularly useful for packaging fast-food products. The carton has extendable panels that are held in their collapsed condition against the outer face of one carton sidewall until extension is desired. Upon extension, scores and cuts in the extendable panels pop out to create a desired three-dimensional scene which may be used for a game or other diversion after the primary packaging role of the carton is accomplished.

It is an object of this invention to provide a folding carton extendable to present a desired three-dimensional scene.

It is another object of this invention to provide a carton blank with three-dimensional pop-outs which may be formed into a flattened carton tube automatically without the need for hand labor.

DETAILED DESCRIPTION OF THE PREFERRRED EMBODIMENT

Figure 1:
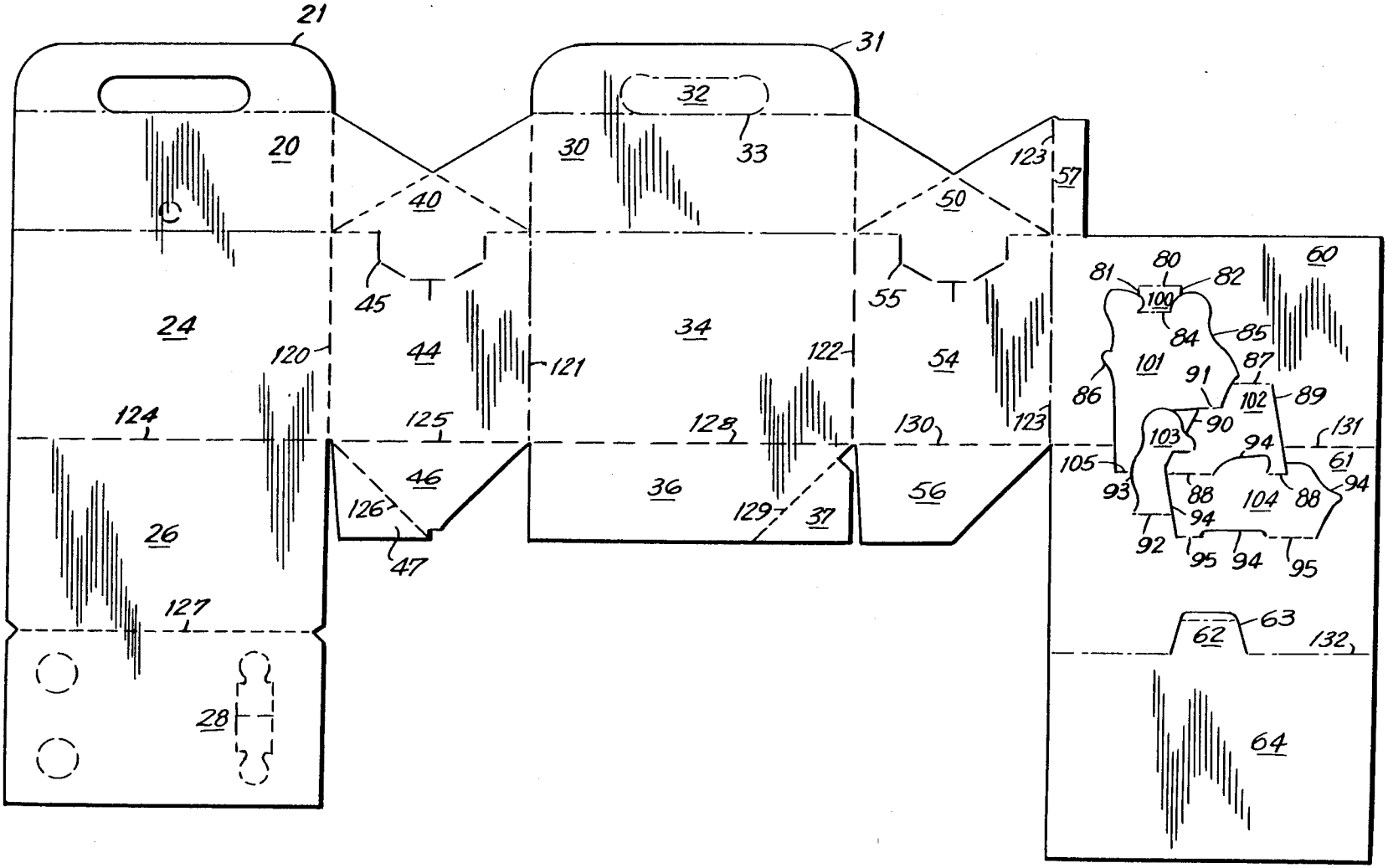
FIG. 1 is a plan view of the exterior surface of the blank used to form the carton of the invention.
Figure 3:
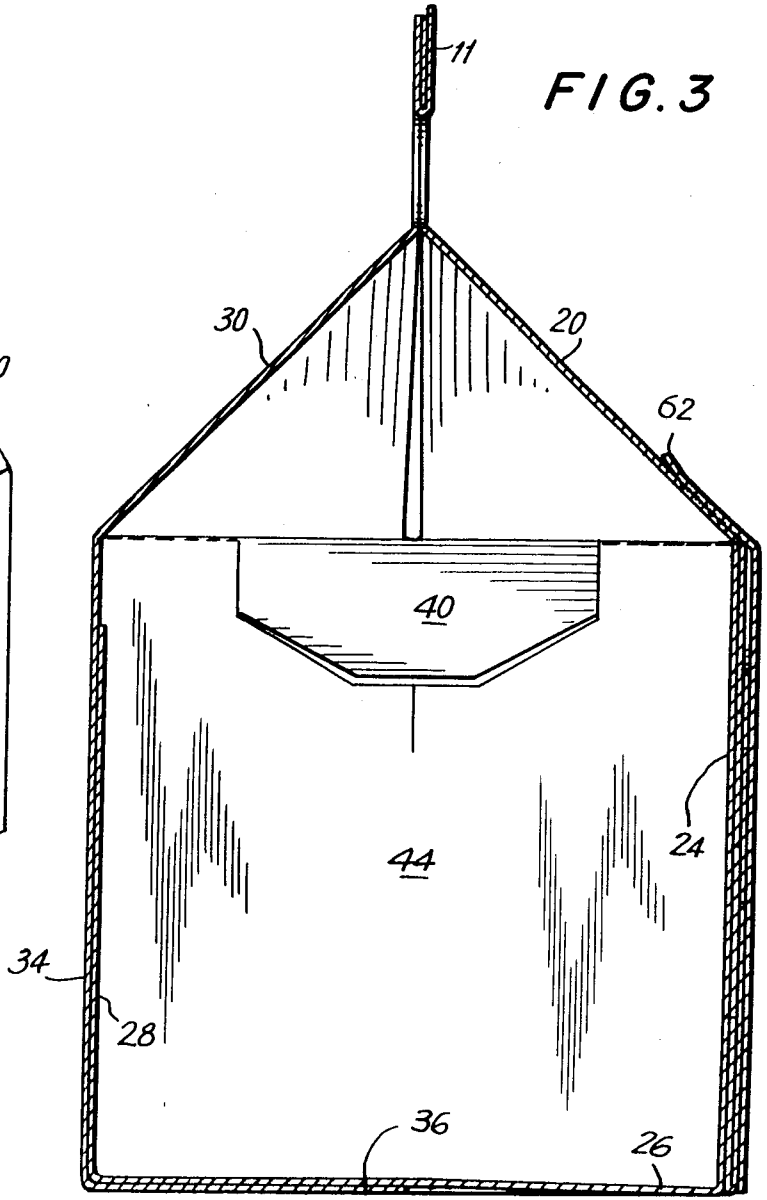
FIG. 3 is a sectional view of the erected carton taken along line 3—3.
Figure 2:
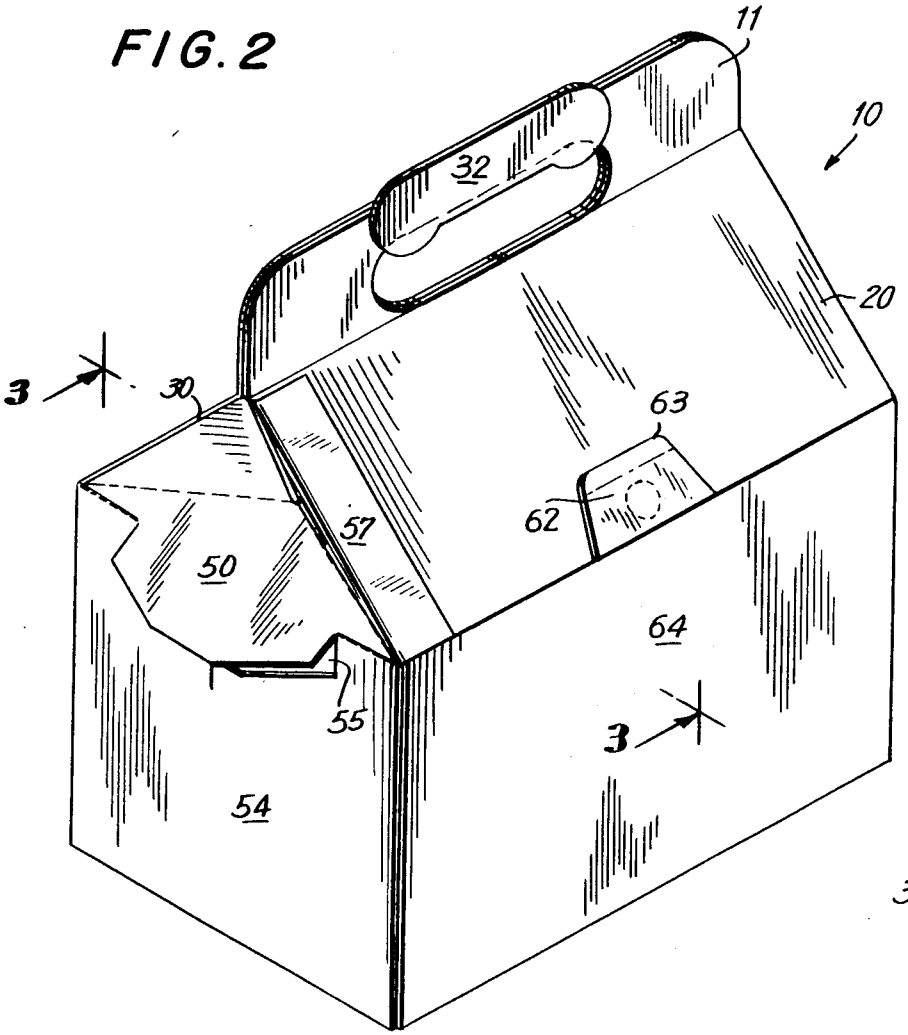
FIG. 2 is a perspective view of the erected carton.
Figure 4:
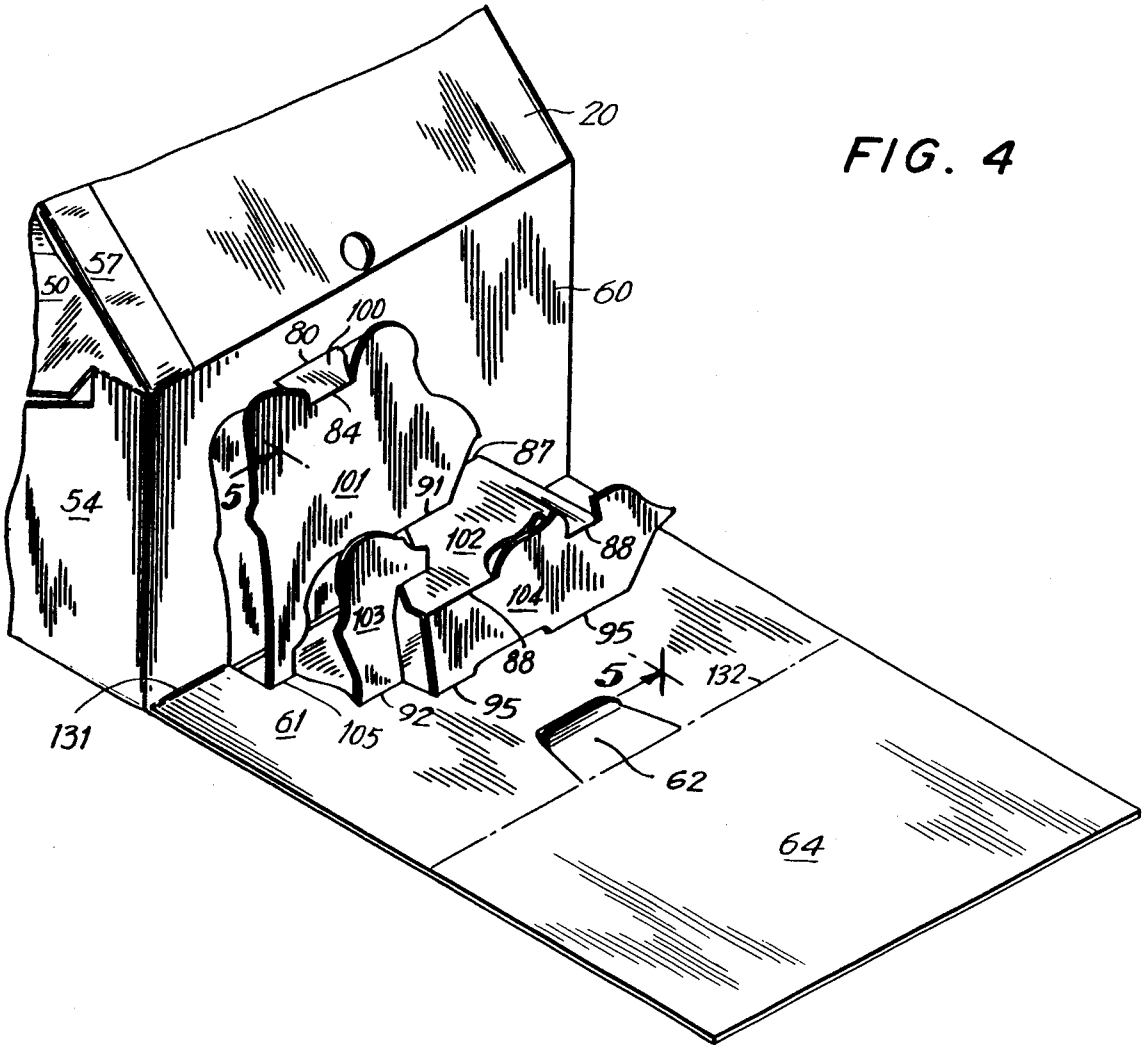
FIG. 4 is a partial perspective view of the carton showing the pop-out panels extended.
Figure 5:
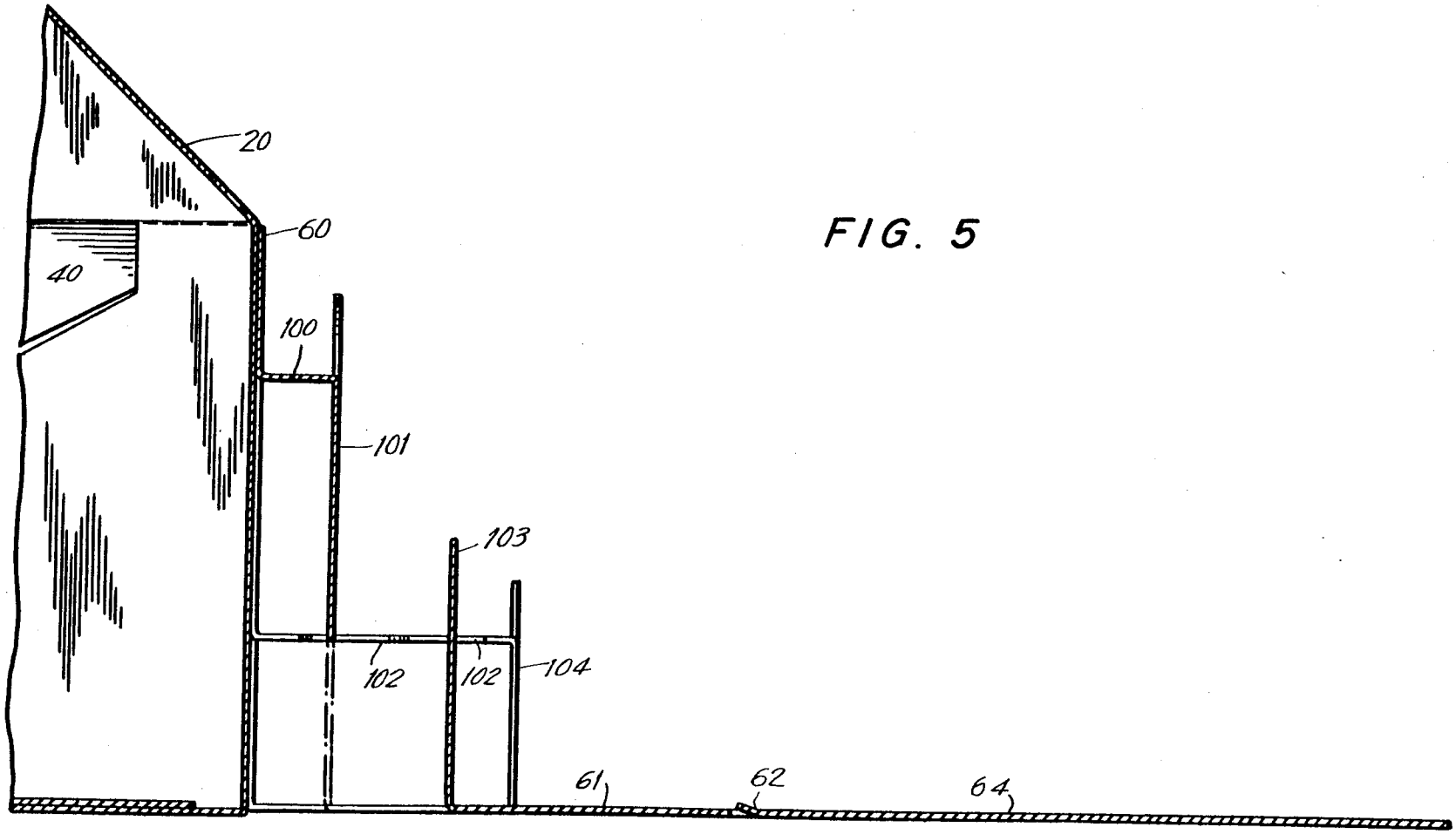
FIG. 5 is a sectional view of the extended pop-out panels taken along line 5—5.

The pop-out carton 10 of this invention is formed from a flat blank appropriately scored and cut for erection. The erected carton has a generally gable-top shape, with roof panels 20 and 30 forming the sloped roof and bow-in panels 40 and 50 tucked under the sloping roof panels 20 and 30. Rib panels 21 and 31 surmount the roof panels 20 and 30 and mate face-to-face to form handle 11 on erection. Rib panel 21 has a hand-hold opening therethrough, while rib panel 31 has a tab 32, defined by "C" shaped cut 33, of slightly smaller size than the opening in rib panel 21. Tab 32 is folded through the opening in rib panel 21 on erection to hold securely the top closure of the carton and to provide the complete handle 11.

The body of the carton is composed of sidewall panels 24 and 34 and end wall panels 44 and 54. Endwall panel 44 is joined to sidewall panel 24 along scoreline 120 and to sidewall panel 34 by scoreline 121. Endwall panel 54 is joined to first pop-out panel 60 by scoreline 123 and to sidewall panel 34 by scoreline 122. Endwall panels 44 and 54 are joined to bow-in panels 40 and 50 by multiple cut lines 45 and 55, respectively, which assist in bowing in panels 40 and 50 beneath roof panels 20 and 30 in erection. Bow-in panel 50 is connected along scoreline 123 to sideseam panel 57, which is an upper extension of pop-out panel 60.

The bottom of the carton is composed of panels and flaps for forming and securing the bottom closure. With the exception of bottom panel 26, which is as wide as the erected carton bottom so as to accommodate auxiliary side panel 28, the bottom panels and flaps are constructed to form a conventional bottom, commonly called an "auto-bottom."

Bottom panel 26 is connected along scoreline 124 to sidewall 24. Triangular bottom tuck-out flap 46 is connected along scoreline 125 to endwall 44 and is notched at its apex. Triangular bottom glue flap 47 is joined to tuck-out flap 46 along scoreline 126, and, in converting of the blank to a flat tube for later erection, it is secured to the outer face of bottom panel 26 so as to pull bottom panel 26 into its position upon erection of the carton. Securing of flap 47 to panel 26 is preferably done by spot gluing.

Auxiliary side panel 28 is joined to bottom panel 26 along scoreline 127. On erection of the carton, it is folded up to lie against the inner face of sidewall panel 34. Panel 28 may be scored, cut, and printed to provide additional punch-out figures or tokens for use with the three-dimensional scene.

Trapezoidal bottom panel 36 is joined to sidewall 34 along scoreline 128. Adjoining panel 36 along scoreline 129 is notched triangular bottom glue flap 37. Glue flap 37 is secured during the converting operation to the outer face of tuck-out flap 56 so as to pull flap 56 into position upon erection of the carton. Tuck-out flap 56 joins end wall 54 at score line 130.

Folding and securing of the various bottom panels and flaps is accomplished mechanically by available and known machinery, such as a Domino 100M gluer made by J. Bobst & Fils S.A., of Switzerland. Such a machine also secures side seam flap 57 and the edge of pop-out panel 60 to the outer face of roof panel 20 and sidewall 24 to form a flat tube for later erection into a carton. An addition to the machine is required to punch out the partially cut pop-out panels during folding, so that they will readily pop out on use, and to fold the pop-out panels into their collapsed position against the face of side wall 24. The attachment is preferably located at a position on the basic converting machine where the blank is momentarily at rest so that the pop-out panels may be punched more easily without interfering with the overall machine operation. A suitable punch out attachment consists of an air-operated stylus conformed to each pop-out pattern and a folding arm to assist folding the pop-out panel and the scene elements into their proper collapsed positions.

The pop-out structure of the carton overlies sidewall 24 after the converting operation and after erection. First pop-out panel 60 is attached to the outer face of sidewall 24. Second pop-out panel 61 is joined to panel 60 along scoreline 131, and has tab 62 defined by cutline 63. Fold out panel 64, of which tab 62 is an integral part, is joined to pop-out panel 61 along scoreline 132. Upon conversion of the blank into a flattened tube carton, tab 62 is preferably spot-glued to roof panel 20 to hold the pop-out panels against the outer face of sidewall 24. The glue seal between tab 62 and roof panel 20 is broken when one desires to fold out panel 64 and pop out the three dimensional scene.

Pop-out panels 60 and 61 are further defined by cut and fold lines as required to form a desired three-dimensional scene. Only one such configuration is illustrated, although the possible three-dimensional pop-out scenes are virtually infinite. To allow the scene to pop away from the surface of pop-out panels 60 and 61, scoreline 131 extends only from the outer margins of the junction of those panels inwardly to the margins of the scene, at which point it intersects cut lines 86, and 89, which define the outer edges of the scene.

Score and cut lines are arranged as required on pop-out panels 60 and 61 to define the vertical and horizontal elements of the scene. In the depicted example, scorelines 80 and 84 and cut lines 81 and 82 define horizontal pop-out tab 100, which, upon unfolding of panels 61 and 64, assists in popping out vertical scene panel 101, defined by irregular cuts 85 and 86 and scorelines 91 and 105, from the surface of panels 60 and 61. Cuts 85 and 86 are shaped to create the desired pop-out scene portion. In the depicted example, cut line 86 extends across both panels 60 and 61, although for a different scene, cut line 85 could so extend.

Scorelines 87, 88, and 91 and cut lines 89 and 90 define horizontal pop-out tab 102. When panels 61 and 64 are folded out, tab 102 pops out into a horizontal position and assists in pulling vertical scene panel 101 into its proper position. Tab 102 also assists in popping out vertical panels 103 and 104 to their proper vertical positions.

In the depicted example, vertical scene panel 103 is defined by scoreline 92 and irregular cut line 93, and scene panel 104 is defined by cut lines 94 and scorelines 88 and 95. As can be appreciated, the several cut lines and scorelines on panels 60 and 61 can be arranged to create any desired three-dimensional scene.

As hinged pop-out panel 61 is rotated to a position normal to panel 60, tabs 100 and 102 are pulled into the horizontal plane. Scene panels 101, 103, and 104 are pulled away from the faces of pop-out panels 60 and 61 until they reach the vertical plane. Tab 100, being shorter than tab 102, pushes scene panel 101 a shorter distance away from the plane of panel 60 than tab 102 pushes panel 104 from that plane. The distance between scorelines 80 and 84 is equal to the distance between scorelines 87 and 91 and between scorelines 131 and 105, so both the top and bottom of scene panel 101 stand off an equal distance from the surface of pop-out panel 60. Similarly, the distance from scoreline 87 to scoreline 88 is equal to that between scorelines 131 and 95, with the same result.

Although fold out panel 64 does not have any pop-out panels, it may be printed to visually form a portion of the total three-dimensional scene. Additional score and cut lines also may be provided on other panels, such as roof panels 20 and 30. These score and cut lines may be used to define manually-erectable figure panels for use in conjunction with the three-dimensional pop-out scene.

We claim:

1. A unitary blank for forming a folding carton comprising:

a. a pair of sidewall panels, the first sidewall panel having a free edge;

b. a pair of endwall panels, the first endwall panel joined to the first and second sidewall panels;

c. a first bottom panel joined to the first sidewall panel;

d. an auxiliary side panel of the same width as the first bottom panel joined to the first bottom panel and foldable normal to the first bottom panel to form an auxiliary sidewall upon erection of the blank into a carton;

e. a pair of roof panels joined to the sidewall panels and surmounted by upper rib panels with openings therein, the rib panels mating face-to-face upon erection of the carton blank to form a handle;

f. a triangular bottom tuck-out flap, notched at its apex, joined to the first end wall panel;

g. a triangular bottom glue flap joined to the bottom tuck-out flap and attachable to the outer face of the first bottom panel so as to pull the first bottom panel into position upon erection of the carton blank;

h. a trapezoidal bottom tuck-out flap joined to the second end wall panel;

i. a trapezoidal bottom panel joined to the second sidewall panel;

j. a second bottom glue flap joined to the trapezoidal bottom panel and attachable to the trapezoidal bottom tuck-out flap so as to pull the tuck-out flap into position upon erection of the carbon blank;

k. a first bow-in panel joined at score lines to the first and second roof panels and joined by score lines and perforated cut lines to the first end wall panel so as to bow in beneath the roof panels upon erection of the carton;

l. a second bow-in panel joined at score lines to the second roof panel and to a side seam panel and joined by score lines and perforated cut lines to the second endwall panel so as to bow-in beneath the roof panels upon erection of the carton;

m. the side seam panel attachable to the outer surface of the first roof panel to form a flattened tube;

n. a first pop-out panel formed as an extension of the side seam panel, of a size substantially equal to a sidewall panel and attachable to the outer surface of a sidewall panel;

o. a second pop-out panel hingedly connected to the first pop-out panel and foldable against a surface of the first pop-out panel;

p. a fold-out panel hingedly connected to the second pop-out panel, foldable against a surface of the second pop-out panel and attachable to the roof panel surmounting the sidewall panel to which the first pop-out panel is attachable; and q. the first and second pop-out panels having partially cut lines and score lines defining a three-dimensional scene collapsed upon the surfaces of the first and second pop-out panels.

2. The blank of claim 1 in which the auxiliary side panel is scored and cut to provide punch-out figures usable in conjunction with the three-dimensional scene.

3. The blank of claim 1 in which at least one of the scene panels and at least one of the pop-out tabs are defined by cut lines which span across the hinged connection between the first pop-out panel and the second pop-out panel.

4. A folding carton formed from a unitary blank comprising:

a. a pair of sidewall panels, the first sidewall panel having a free edge;

b. a pair of endwall panels, the first endwall panel joined to the first and second sidewall panels;

c. a first bottom panel joined to the first sidewall panel;

d. an auxiliary side panel of the same width as the first bottom panel joined to the first bottom panel and foldable normal to the first bottom panel to form an auxiliary sidewall upon erection of the carton;

e. a pair of roof panels joined to the sidewall panels and surmounted by upper rib panels with openings therein, the rib panels mating face-to-face upon erection of the carton to form a handle;

f. a triangular bottom tuck-out flap, notched at its apex, joined to the first end wall panel;

g. a triangular bottom glue flap joined to the bottom tuck-out flap and attachable to the outer face of the first bottom panel so as to pull the first bottom panel into position upon erection of the carton;

h. a trapezoidal bottom tuck-out flap joined to the second end wall panel;

i. a trapezoidal bottom panel joined to the second sidewall panel;

j. a second bottom glue flap joined to the trapezoidal bottom panel and attachable to the trapezoidal bottom tuck-out flap so as to pull the tuck-out flap into position upon erection of the carton;

k. a first bow-in panel joined at score lines to the first and second roof panels and joined by score lines and perforated cut lines to the first end wall panel so as to bow in beneath the roof panels upon erection of the carton;

l. a second bow-in panel joined at scorelines to the second roof panel and to a side seam panel and joined by score lines and perforated cut lines to the second endwall panel so as to bow-in beneath the roof panels upon erection of the carton;

m. the side seam panel attachable to the outer surface of the first roof panel to form a flattened tube;

n. a first pop-out panel formed as an extension of the side seam panel, of a size substantially equal to a sidewall panel and attachable to the outer surface of a sidewall panel;

o. a second pop-out panel hingedly connected to the first pop-out panel and foldable against a surface of the first pop-out panel;

p. a fold-out panel hingedly connected to the second pop-out panel, foldable against a surface of the second pop-out panel and attachable to the roof panel surmounting the sidewall panel to which the first pop-out panel is attachable; and q. the first and second pop-out panels having partially cutlines and score lines defining a three-dimensional scene collapsed upon the surfaces of the first and second pop-out panels.

5. The carton of claim 4 in which the auxiliary side panel is scored and cut to provide punch-out figures usable in conjunction with the three-dimensional scene.

6. The carton of claim 4 in which at least one of the scene panels and at least one of the pop-out tabs are defined by cut lines which span across the hinged connection between the first pop-out panel and the second pop-out panel.

* * * * *